US005674105A

United States Patent [19]

Hamlin

[11] Patent Number: 5,674,105

[45] Date of Patent: Oct. 7, 1997

[54] SELF-PROPELLED TOY VEHICLE

[75] Inventor: John Hamlin, Redondo Beach, Calif.

[73] Assignee: Namkung Promotions Inc., Costa Mesa, Calif.

[21] Appl. No.: 644,832

[22] Filed: May 10, 1996

[51] Int. Cl.[6] ..... A63H 29/00

[52] U.S. Cl. ..... 446/457; 446/430

[58] Field of Search ..... 446/430, 457, 446/465

[56] References Cited

U.S. PATENT DOCUMENTS

| | | | |
|---|---|---|---|
| 4,345,402 | 8/1982 | Hanson et al. | 446/430 |
| 4,411,098 | 10/1983 | Birdsall et al. | 446/457 |
| 4,443,966 | 4/1984 | Birdsall | 446/430 |

FOREIGN PATENT DOCUMENTS

| | | | |
|---|---|---|---|
| 449886 | 1/1949 | Italy | 446/430 |

*Primary Examiner*—Mickey Yu

*Attorney, Agent, or Firm*—Stetina Brunda Garred & Brucker

[57] ABSTRACT

A self-propelled toy vehicle suitable to be given away as a promotional item includes a body shell, having a rear opening or key hole to an internal propulsion mechanism that contains a compression spring. The tip of a separate, key-shaped actuator is insertible into the propulsion mechanism to distort the spring. The actuator also preferably includes a latch member that engages a complimentary capture member in the propulsion mechanism. The latch member is manually disengaged, propelling the body shell forward utilizing the opposing force of the compression spring. The promotional toy is fun and safe to use, and may be manufactured inexpensively.

13 Claims, 2 Drawing Sheets

Fig. 1
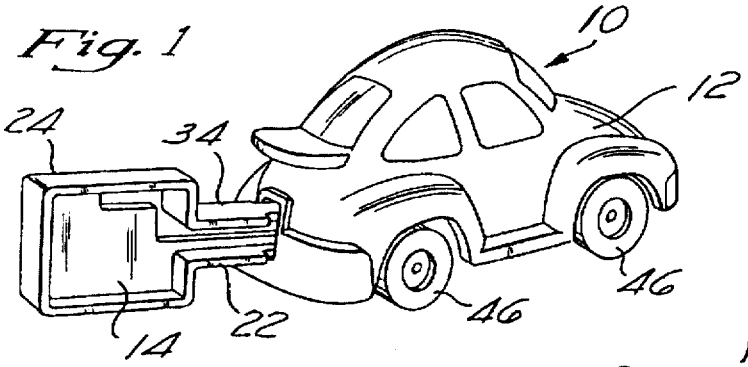
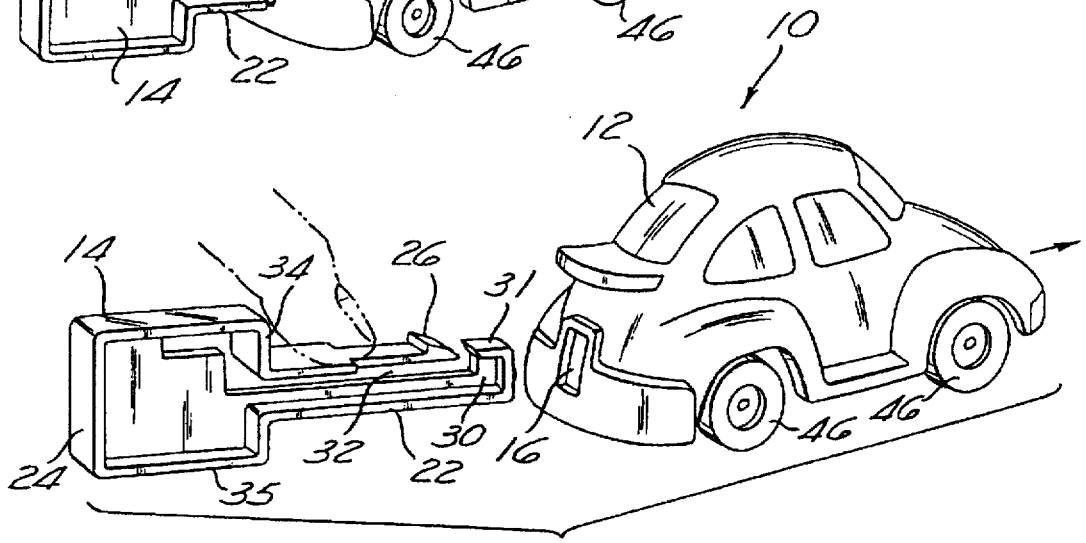
Fig. 2
Fig. 3
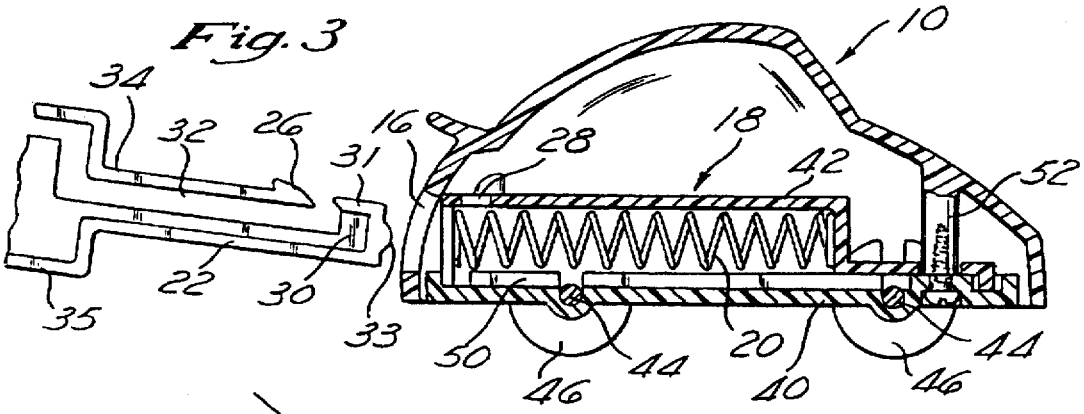
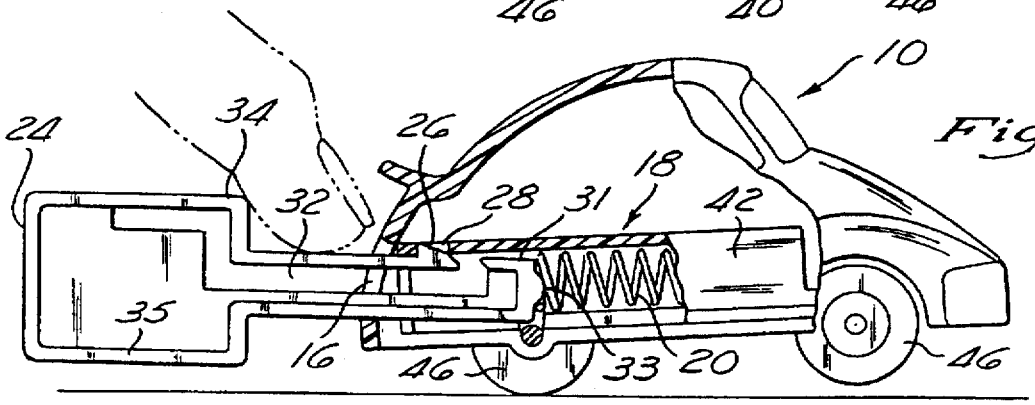
Fig. 4

SELF-PROPELLED TOY VEHICLE

FIELD OF THE INVENTION

The present invention relates generally to powered toy vehicles, and more particularly to such vehicles which are very inexpensive to produce and thus suitable to be utilized as promotional items as part of an advertising program.

BACKGROUND OF THE INVENTION

The use of toy vehicles as promotional items is prevalent as a merchandising tool to attract customers. For example, families with children are targeted by fast food chains and the like through the use of promotional give-away items to increase the frequency of their visits. Promotional items such as coffee or drink mugs, however, are ordinary and commonplace and generally do not stimulate much business. Other products such as battery-powered miniature cars or the like are attractive, but may be too costly to hand out to customers on a mass scale. Additionally, with any toy given to children it must be proven safe without question.

In view of the marketing opportunity available to retail businesses, it is desirable to provide a promotional toy that is fun and safe to use, and can be manufactured inexpensively. The self-propelled toy vehicle of the present invention, to Applicant's knowledge, is novel and meets the above-mentioned objectives.

SUMMARY OF THE INVENTION

The present invention consists of a toy vehicle including a body shell having a propulsion mechanism disposed therein. A separate actuator is configured to be partially inserted into the propulsion mechanism and deform an elastic member therein, that creates an opposing force against the actuator. The opposing force may be used to propel the body shell away from the actuator. The elastic member is preferable a spring, that upon being deformed by the actuator is in a compressed state. The actuator also preferably has a latch member that engages a complimentary capture member in the propulsion mechanism, so that the actuator may be securely held in the propulsion mechanism until the user is ready to propel the body shell away from the actuator. The actuator latch member is preferably deformable, such that the actuator may be released by bending the latch member away from engagement with the propulsion mechanism capture member.

Other special features of the toy vehicle add to the novelty and utility of the invention. The actuator is preferably formed in the shape of a conventional key, having a tip portion that is inserted into the propulsion mechanism, and having a bow portion that is grasped by the user in releasing the body shell from the actuator. Additionally, the actuator tip portion preferably has material removed around the latching member to form a void, the void extending from the tip into the bow portion of the actuator. This configuration allows the user to release the body shell from the actuator by deflecting the latch member out of engagement with the capture member. The lower portion of the actuator bow is also preferably flat to form a base, that may be brought to bear against a flat surface such as the tabletop or floor when pushing on the actuator to disengage and propel the toy vehicle.

These, as well as other advantages of the present invention will become more apparent from the following description and drawings. It is understood that changes in the specific structure shown and described may be made within the scope of the claim below without departing from the spirit of the invention.

BRIEF DESCRIPTION OF THE DRAWINGS

FIG. 1 is a perspective view of the toy vehicle in accordance with the preferred embodiment of the present invention, shown with the actuator inserted in the propulsion mechanism inside the body shell;

FIG. 2 is perspective view of the toy vehicle, shown being propelled forward, away from the actuator.

FIG. 3 is a side sectional view showing the propulsion mechanism and compression spring contained therein, prior to inserting the actuator into the propulsion mechanism;

FIG. 4 is a side sectional view showing the actuator as retained in the propulsion mechanism.

DETAILED DESCRIPTION OF THE PREFERRED EMBODIMENT

Figure 5:
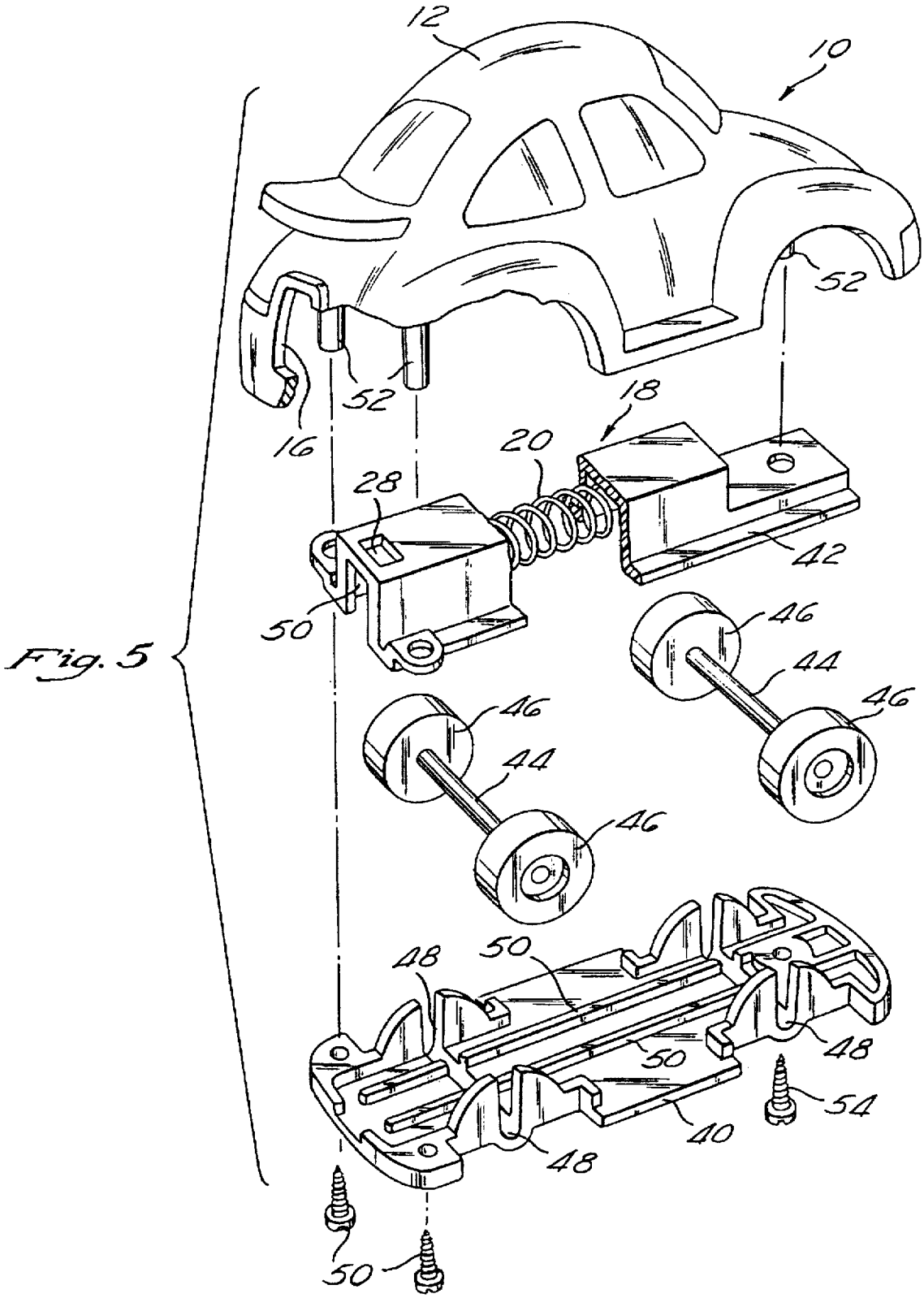
FIG. 5 is an enlarged, exploded perspective view showing the assembly of the toy vehicle of the preferred embodiment.

The detailed description set forth below in connection with the appended drawings is intended as a description of the presently preferred embodiment of the invention, and is not intended to represent the only form in which the present invention may be constructed or utilized. The description sets forth the functions and sequence of steps for constructing and operating the invention in connection with the illustrated embodiment. It is to be understood, however, that the same or equivalent functions and sequences may be accomplished by different embodiments that are also intended to be encompassed within the spirit and scope of the invention.

The toy vehicle of the present invention as illustrated in FIGS. 1 through 4, which depict a presently preferred embodiment of the invention. First referring to FIGS. 1 and 2, the toy vehicle 10 is comprised generally of a body shell 12 resembling a conventional automobile, and a separate actuator 14 in the shape of a conventional key. The body shell 12 preferably has a small rear opening or key hole 16, to a propulsion mechanism 18 (see FIGS. 3 and 4), into which one end of the actuator 14 may be inserted into the body shell 12. For child safety, importantly the key hole 16 is too small to accept a finger, thereby preventing any contact with the propulsion mechanism. The propulsion mechanism 18 preferably includes a spring 20 held captive therein, and the spring 20 is distorted upon pushing the actuator 14 into the propulsion mechanism 18. In this embodiment, a force is loaded onto a compression spring 20, and that stored force is used to oppose the actuator 14 and propel the body shell 12 forward, away from the actuator 14.

The actuator 14 is preferably shaped like a key, having a tip portion 22 with an "I" cross section sized to be slidably inserted into the propulsion mechanism 18, and having an enlarged bow portion 24 to be readily grasped by the user. The forward end 31 of the tip portion 22 preferably includes a rounded bulb 33, that fits inside the wound, helical coil of the compression spring 20. An upper flange 34 of the tip portion 22 includes a latch member or retaining tab 26, sized to engage a complimentary capture member or retaining slot 28 in the propulsion mechanism 18. Additionally, material is removed from the web 30 of the "I" section of the tip 22, to form a void 32 in the proximity of the latch member or retaining tab 26 and extending into the bow portion 24 of the actuator 14. Accordingly, the actuator 14 tip portion 22 may be inserted into the propulsion mechanism 18 and the spring 20 compressed until the retaining tab 26 is engaged in the retaining slot 28, thereby locking the actuator 14 in place against the loaded spring 20. Then, by simply deflecting the upper flange 34 of the actuator 14 such that the retaining tab 26 is disengaged from the retaining slot 28, the opposing force of the compression spring 20 is operative to push the body shell 12 away from the actuator 14.

Now referring to FIG. 5, details of the construction of the toy vehicle 10 of the preferred embodiment of the present invention may be described. The body shell 12 includes an undercarriage or frame 40, a propulsion housing 42, an a pair of axles 44 each having a pair of wheels 46. The undercarriage or frame 40 is configured to include a pair of groves 48 which support the pair of axles 44. The frame 40 is also configured with a pair of longitudinal rails 50, which together with the propulsion housing 42 form the propulsion mechanism 18. The rails 50 are spaced apart to accommodate the cross-sectional width of the tip portion 22 of the actuator 14. The overlying propulsion housing 42 has a rear opening 50 sized to accept the cross section of the actuator 14, while retaining the compression spring 20 therein safely away from the key hole 16. Additionally, three mounting posts 52 extend vertically from the body shell 12 through the propulsion housing 42 and into the undercarriage or frame 40, and three conventional mounting screws 54 secure the frame 40 to the mounting post 52. As assembled the axles 44 are free to rotate with respect to the frame 40, and/or the wheels 46 freely rotate about the axles 44. With the exception of the compression spring 20 and mounting screws 54 being standard metal hardware, the remainder of the toy vehicle 10 is preferably fabricated of molded plastic material offering the dual advantages of low cost and lightweight.

Having described the structure of the toy vehicle 10, it is now possible to describe its operation, function and use. To utilize the toy vehicle 10, a user, most likely a child, places the body shell 12 upon a flat surface such as a table top, floor, sidewalk, or the like. With one hand, the user holds the body shell 12, and with the other hand grasps the key-shaped actuator 14 about the bow portion 24, and inserts the tip portion 22 into the rear opening or key hole 16 of the body shell 12. Upon pushing the tip portion 22 of the actuator 14 into the propulsion mechanism 18, the spring 20 is compressed until the latch member or retaining tab 26 becomes engaged in the capture member or elongate slot 28 of the propulsion housing 42. At this point, the actuator 14 is locked into the body shell 12 of the toy vehicle 10 with the spring 20 compressed. Now the user merely deflects the upper flange 34 of the actuator 14, to move the retaining tab 26 out of engagement with the retaining slot 28.

In deflecting the upper flange 34 of the actuator 14, the user would typically grasp the actuator 14 between multiple fingers holding the top flange 34 and bottom flange 35. Alternatively, it may prove useful to rest the bottom flange or base 35 of the actuator 14 directly against the table top or other flat surface. As is apparent from FIG. 4, importantly the propulsion mechanism 18 is configured so that the tip portion 22 of the actuator 14 is inserted a fixed distance inside the propulsion mechanism 18, such that the forward end 31 lies approximately above the rear axle 44. In this way when the user deflects the upper flange 34 to release the latch member or retaining tab 26 from the capture member or retaining slot 28, the downward force is transmitted, in part, approximately vertically into the rear axle 44 and wheels 46. The body shell 12 is propelled forward without being unduly rotated about the rear axle 44 by a downward force applied substantially aft of the rear axle 44. Additionally, the body shell 12 is propelled forward without being held back by a downward force applied substantially forward of the rear axle 44.

It is understood that the toy vehicle described herein and shown in the drawings represents only a presently preferred embodiment of the invention. Indeed, various modifications and additions may be made to the embodiment shown without departing from the spirit and scope of the invention. By way of example only, the toy vehicle could be configured as an airplane or missile which is launched through the air rather than being propelled forward along a flat surface. Such a modification may be obvious to those skilled in the art and may be implemented to adapt the present invention for use in a variety of different applications.

What is claimed is:

1. A toy vehicle comprising:

a) a body shell including a front axle mounted transverse to a front portion of an undercarriage of the body shell and a rear axle mounted transverse to a rear portion of said undercarriage, each of said axles having one or more wheels connected thereto such that the wheels are rotatable relative to the body shell;

b) a propulsion mechanism disposed proximate to said body shell and accessible from a rear aperture;

c) an elastic member disposed in said propulsion mechanism; and d) an actuator having one end insertable into the propulsion mechanism through the rear aperture thereof to terminate with a terminal end substantially above the rear axle and deform the elastic member to thereby create an opposing force such that the body shell may be propelled away from said actuator by said opposing force upon releasing the actuator from the propulsion mechanism, with the release of said actuator requiring a downward force thereon transferable at least in part to the terminal end of the actuator and the rear axle.

2. The toy vehicle of claim 1 wherein the elastic member is a spring.

3. The toy vehicle of claim 2 wherein the spring is a compression spring.

4. The toy vehicle of claim 1 wherein said one end of the actuator has a latch member and the propulsion mechanism has a capture member sized to receive a retaining tab, such that the actuator may be retained in the propulsion mechanism until the body shell is ready to be propelled away from the actuator.

5. The toy vehicle of claim 4 wherein said latch member is deformable, such that the latch member may be released from said capture member by deforming the latch member.

6. The toy vehicle of claim 5 wherein the one end of the actuator has material removed proximate the latch member forming a void, such that the latch member is deformable.

7. The toy vehicle of claim 6 wherein said void formed from material removed proximate the latch member extends into an opposing end of the actuator, such that deforming said opposing end may deform the latch member.

8. The toy vehicle of claim 6 wherein an opposing end of the actuator has a substantially flat base, such that said flat base may bear against a flat surface in deforming the latch member.

9. The toy vehicle of claim 7 wherein the overall shape of the actuator is that of a conventional key having a tip portion and a bow portion, with the one end of the actuator corresponding to said tip portion and the opposing end corresponding to said bow portion.

10. The toy vehicle of claim 8 wherein the propulsion mechanism is an enclosed slot extending longitudinally from a rear opening in the body shell to inside the body shell.

11. The toy vehicle of claim 10 wherein said enclosed slot extends inside the body shell above said rear axle.

12. The toy vehicle of claim 10 wherein said rear opening is sized to receive the one end of the actuator insertible into the enclosed slot, and is sized to retain the elastic member captive inside the enclosed slot.

13. The toy vehicle of claim 8 wherein the body shell extends upward from the undercarriage, such that the overall shape of the body shell is that of a conventional car.

* * * * *